US007610725B2

(12) United States Patent
Willert

(10) Patent No.: US 7,610,725 B2
(45) Date of Patent: Nov. 3, 2009

(54) METHOD AND SYSTEM FOR VENTING ROOFS AND WALLS

(76) Inventor: Wayne A. Willert, 22 Second Ave., Port Washington, NY (US) 11050

( * ) Notice: Subject to any disclaimer, the term of this patent is extended or adjusted under 35 U.S.C. 154(b) by 801 days.

(21) Appl. No.: 11/179,721

(22) Filed: Jul. 12, 2005

(65) Prior Publication Data

US 2007/0011956 A1 Jan. 18, 2007

(51) Int. Cl.
*E04D 13/17* (2006.01)

(52) U.S. Cl. ..... 52/95; 52/96; 52/302.1; 454/250

(58) Field of Classification Search ..... 52/95, 52/96, 198, 199, 302.1, 302.3, 302.6, 302.7; 454/271, 270, 243, 241, 250
See application file for complete search history.

(56) References Cited

U.S. PATENT DOCUMENTS 1,028,725 A * 6/1912 Hodgson ..... 52/22
4,096,790 A * 6/1978 Curran ..... 454/260
4,642,958 A * 2/1987 Pewitt ..... 52/302.3
5,052,286 A * 10/1991 Tubbesing et al. ..... 454/365
5,054,254 A * 10/1991 Sells ..... 52/199
5,070,771 A * 12/1991 Mankowski ..... 454/275
5,094,041 A * 3/1992 Kasner et al. ..... 52/57
5,112,278 A * 5/1992 Roberts ..... 454/365
5,457,920 A * 10/1995 Waltz ..... 52/199
5,761,864 A * 6/1998 Nonoshita ..... 52/302.3
5,832,677 A * 11/1998 Kurttila ..... 52/95
6,145,255 A * 11/2000 Allaster ..... 52/95
6,595,849 B2 * 7/2003 Miller ..... 454/365
6,780,099 B1 * 8/2004 Harper ..... 454/186
2002/0194799 A1 * 12/2002 Sharp et al. ..... 52/198

OTHER PUBLICATIONS

ICBO Evaluation Service, Inc. "Acceptance Criteria for Attic Vents" Published ICBO Evaluation Service, Inc., Whittier, CA; 2001, pp. 1-5.
COR-A-VENT, Inc.; 2004; 4 pages.

* cited by examiner

*Primary Examiner*—Robert J Canfield
*Assistant Examiner*—James J Buckle, Jr.
(74) *Attorney, Agent, or Firm*—Keusey, Tutunjian & Bitetto, P.C.

(57) ABSTRACT

A venting system that is incorporated into the roof and/or wall allows the same to provide continuous air flow to ventilate the roofs and walls and prevent condensation build up and ultimate water damage to the structure. The channeled venting system is incorporated into the roof and/or wall sheathing and thereby is not prone to blockage by improper or amateur insulation installations.

15 Claims, 7 Drawing Sheets

METHOD AND SYSTEM FOR VENTING ROOFS AND WALLS

BACKGROUND OF THE INVENTION

1. Field of the Invention

The present invention relates to construction. More particularly, it relates to the venting of roofs and walls to prevent condensation build up and water damage to structures.

2. Description of the Prior Art

Insulating attic and wall areas has become a necessity for new or existing structures. The insulating of these areas is imperative for energy conservation. However, it is very easy to incorrectly insulate these areas. By way of example, an overly insulated area (e.g., wall or attic space stuffed with the wrong "R-factor" insulation of simply too much of the power R-factor insulation, will result in condensation build up and ultimate water damage to the structure. Another example would include newly developed materials that seal any air flow normally Unfortunately, even properly vented roofs are easily blocked by new insulation installations. This is generally due to the fact that at the lowest insulated areas (e.g., where the roof rafters meet the ceiling joists), there is not enough room for an individual to maneuver, in addition, the installer's vision is impaired for proper installation. Venting through varying projected soffet over hang areas leaves a gap or blockage with insulation between the soffet rafters, thus not allowing seepage of cross ventilation of outside air into the structure. Cross ventilation is needed to eliminate water condensation.

Thus, there is a need for a roof/wall venting system that cannot be impaired or blocked by improper insulation installations. In order to provide this system, the venting system must become part of the roof/wall structure or fascia/gable end, yet not be exposed to the exterior weather, so as to protect the venting system and air flow there through.

SUMMARY OF THE INVENTION

It is therefore an aspect of the present invention to provide a roof/wall venting system that cannot be impaired or blocked by improper insulation installations.

It is another aspect of the invention to provide a roof/wall venting system that is completely concealed and not visible to the consumer once installed.

This and other aspects are achieved in accordance with the invention wherein the venting system for roofs include an opening in the roof sheathing extending from the base of the roof upward toward a peak of the roof, a lower support member positioned in the opening such that a gap between the lower support member and the roof sheathing exists. The lower support member has a thickness smaller than the predetermined thickness of the roof sheathing. A channel vent is disposed in the opening and on the lower support member. The channel vent has a plurality of parallel vents with open ends and a thickness smaller than the predetermined thickness of the roof sheathing. The channel vent is positioned in the opening such that at least one of the open ends is disposed in said gap.

According to a preferred embodiment, the roof has a sheathing of a predetermined thickness which is defined according to minimum strength requirements. The combined thickness of the channel vent and the lower support member in the opening have a minimum strength equal to or greater than the minimum strength requirement of the roof sheathing.

According to further embodiments, the venting system includes a first water protection membrane disposed over the lower support member such that it is positioned between the channel vent and the lower support member. The system may also include a second water protection membrane disposed over the roof venting system and extending up onto the roof sheathing above the roof venting system in the direction of a roof peak.

In a preferred embodiment, the lower support member and the channel vent have a combined thickness equal to or greater than the thickness of the roof sheathing.

According to other embodiments, the method for venting a roof includes removing a lower portion of the roof sheathing, positioning a lower support member in the removed lower portion so as to define a gap between the lower support member and the remaining roof sheathing, providing a channel vent disposed on said lower support member and extending from a roof base to the remaining roof sheathing, said channel vent having one open end exposed to exterior air at the roof base and another open end disposed in said defined gap, and providing a water protection membrane adapted to cover said channel vent and extend upward from the roof base beyond said defined gap.

In further embodiments, the said channel vent and the lower support member have a combined thickness equal to a thickness of the remaining roof sheathing.

The providing of a water protection membrane includes installing an ice dam prevention material over the channel vent such that it extends upward from the roof base beyond the defined gap.

Other aspects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
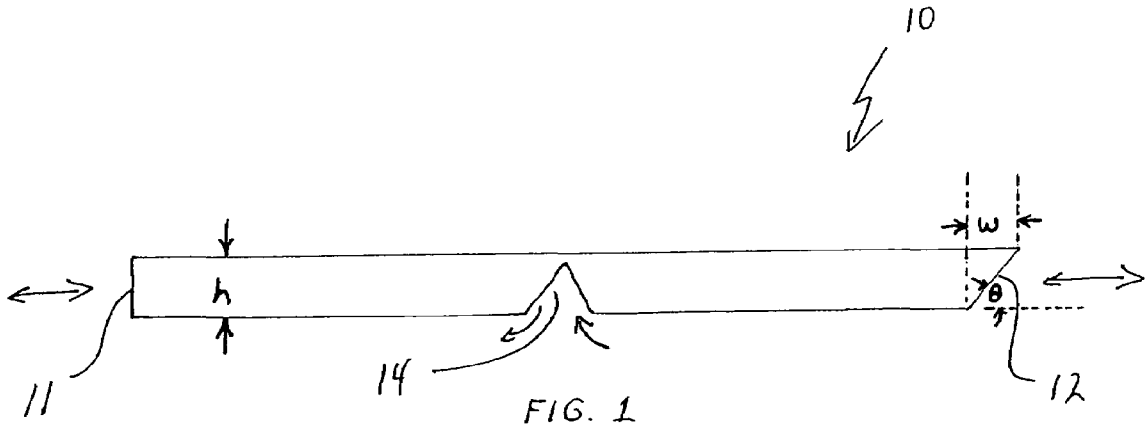
FIG. 1 is side view of a corrugated vent according to an aspect of the invention.
Figure 2A:
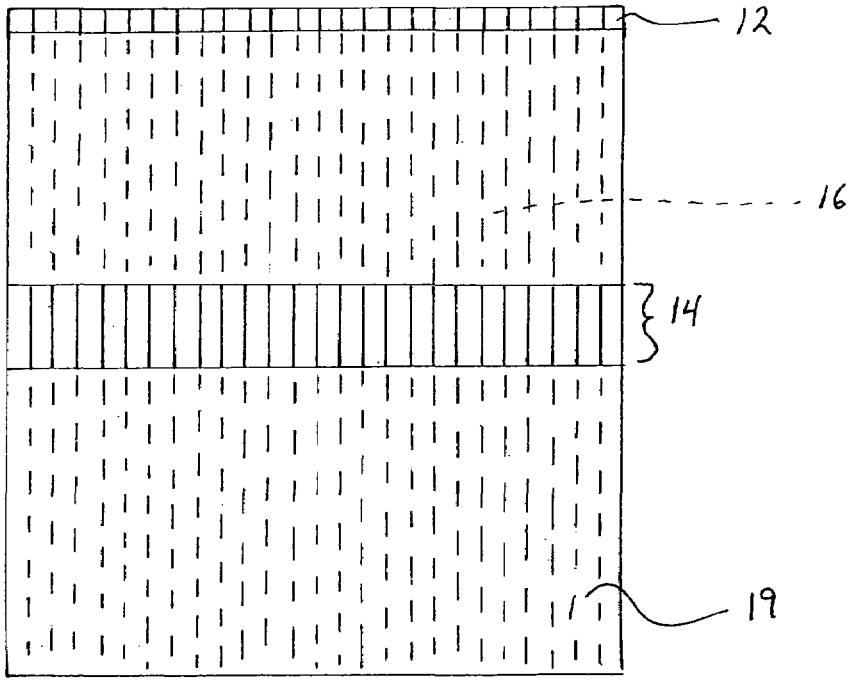
FIGS. 2*a* and 2*b* are bottom views is a bottom view of the corrugated vent according to an aspect of the invention.
Figure 2B:
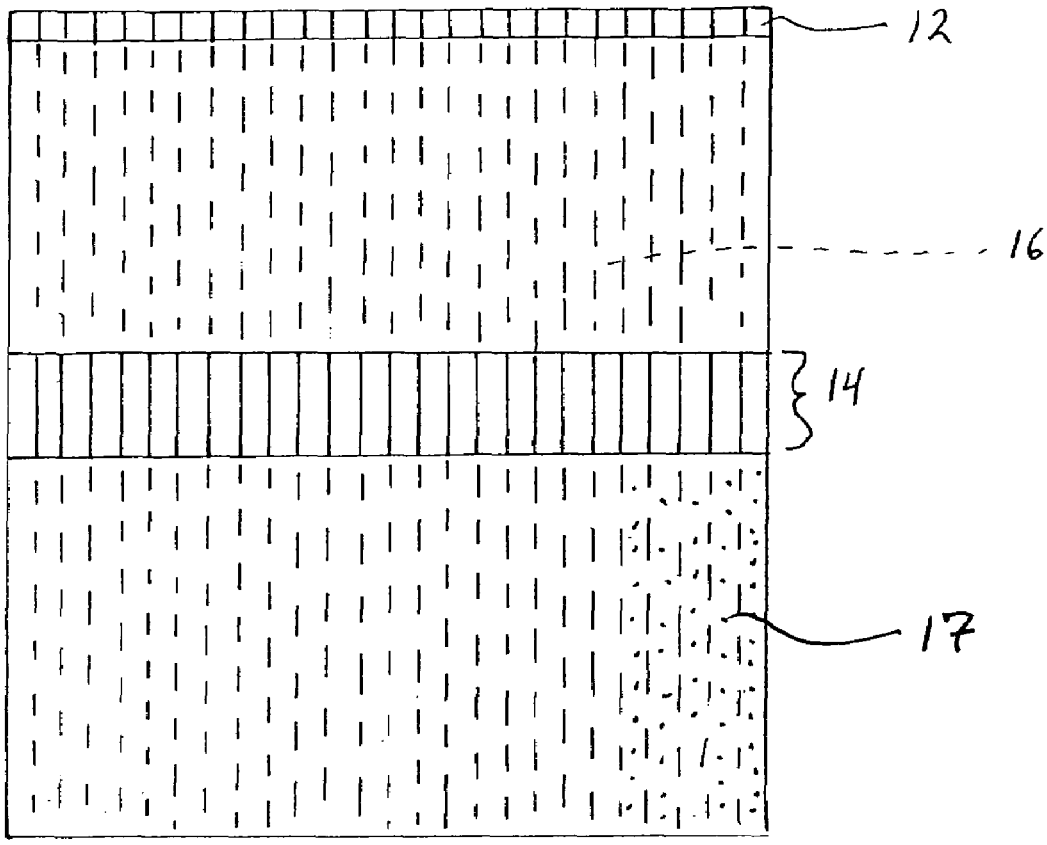

FIGS. 1 and 2 show a corrugated vent 10 according to an aspect of the invention. The vent has a height h that can be any suitable height to provide a flush finish to the wall or roof. According to one preferred aspect of the invention, height h is ⅛ inch. The vent 10 has a plurality of vents 16 and is open at each end 11 and 12 and which have a predetermined opening size and spacing. By way of example, corrugated vents like vent 10 are known by the Acceptance Criteria for Attic Vents (AC132) issued by the ICBO Evaluation Service, and which is incorporated herein by reference. The AC132 report sets forth venting size and requirements for Attic venting. The vent 10 of the present invention complies with all venting criteria set forth in AC132. Venting material such as vent 10 is sold under the trademark COR-A-VENT®, which is registered to Cor-A-Vent Inc. in Michigan.

According to certain aspects of the invention, a straight end 11 can be used, while an angled end 12 can be used to change the size of the air openings to the vents 16. The angled end 12 has a width w that determines the size of the air opening on that end and also changes the angle θ. The larger the width w, the longer the air openings and the smaller angle θ. The overall length of the vent 10 can be infinitely varied according to the particular installation without changing the function or operation thereof.

According to other embodiments, vent 10 can include an adhesive backing 19 over the entire surface thereof. This adhesive backing will adhere the vent 10 to the wood and thereby hold the vent in place while the remainder of the roof or wall installation is completed.

Channel 14 is cut into vent 10 transverse to the plurality of vents 16. The channel 14 provides additional air input/output from the vent. As will be described later with reference to FIGS. 3 and 4, the channel 14 allows for increased air flow (venting) of the roof and/or wall. In other embodiments, the corrugated vent 10 may include perforations or small holes 17 on one side thereof. The purpose for such perforations would be to increase airflow, and more particularly, would operate to provide the required airflow in installations where an open end (11, 12) is not possible. For example, in some cement or block like constructions, one or both of the open ends can be closed by the construction itself. As such, perforations 17 will provide airflow even when the opens ends 11, 12 are blocked.

Figure 3A:
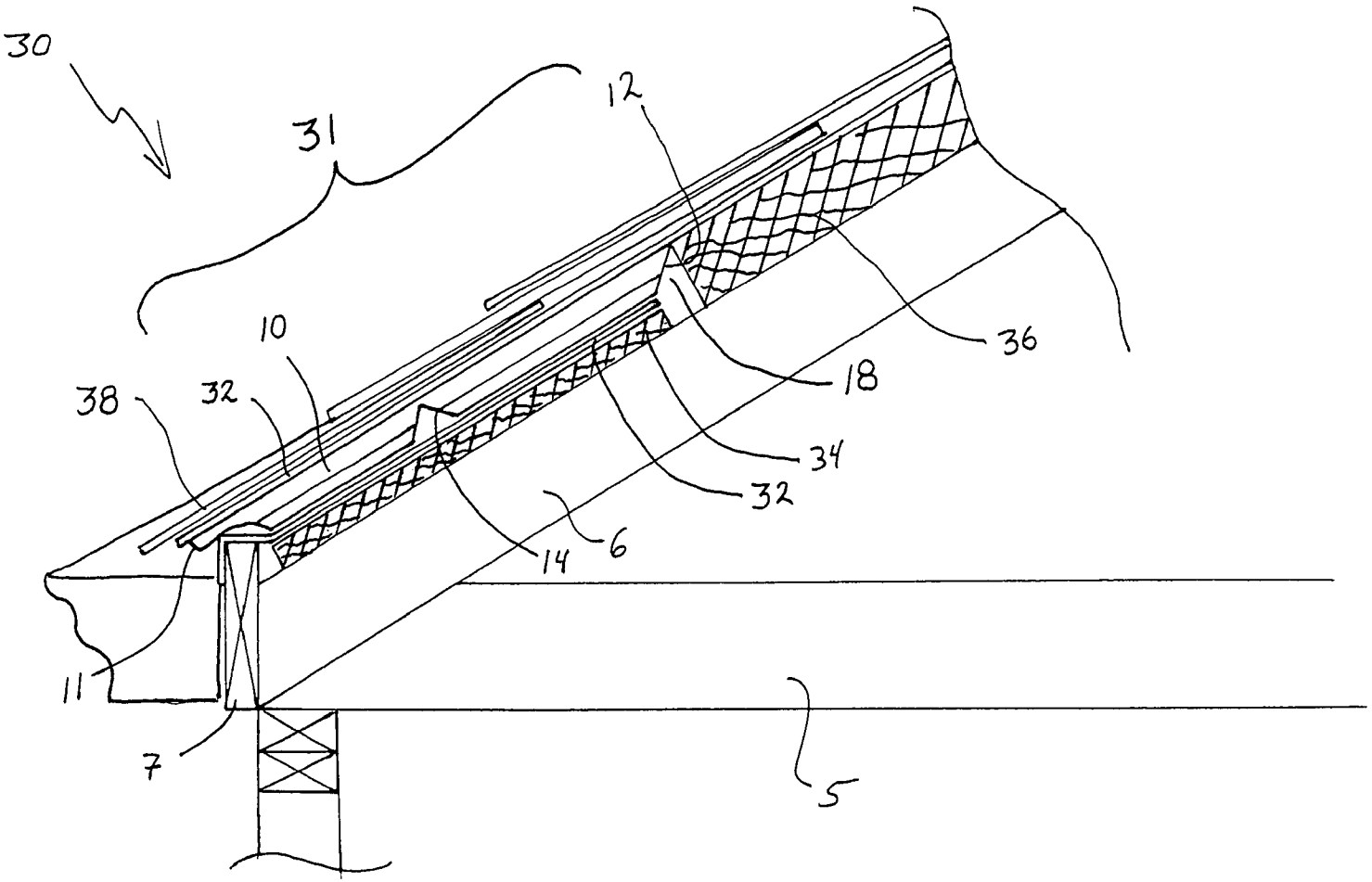
FIG. 3*a* is a partial cross sectional view of a roof line showing the venting system according to an aspect of the invention.
Figure 3B:
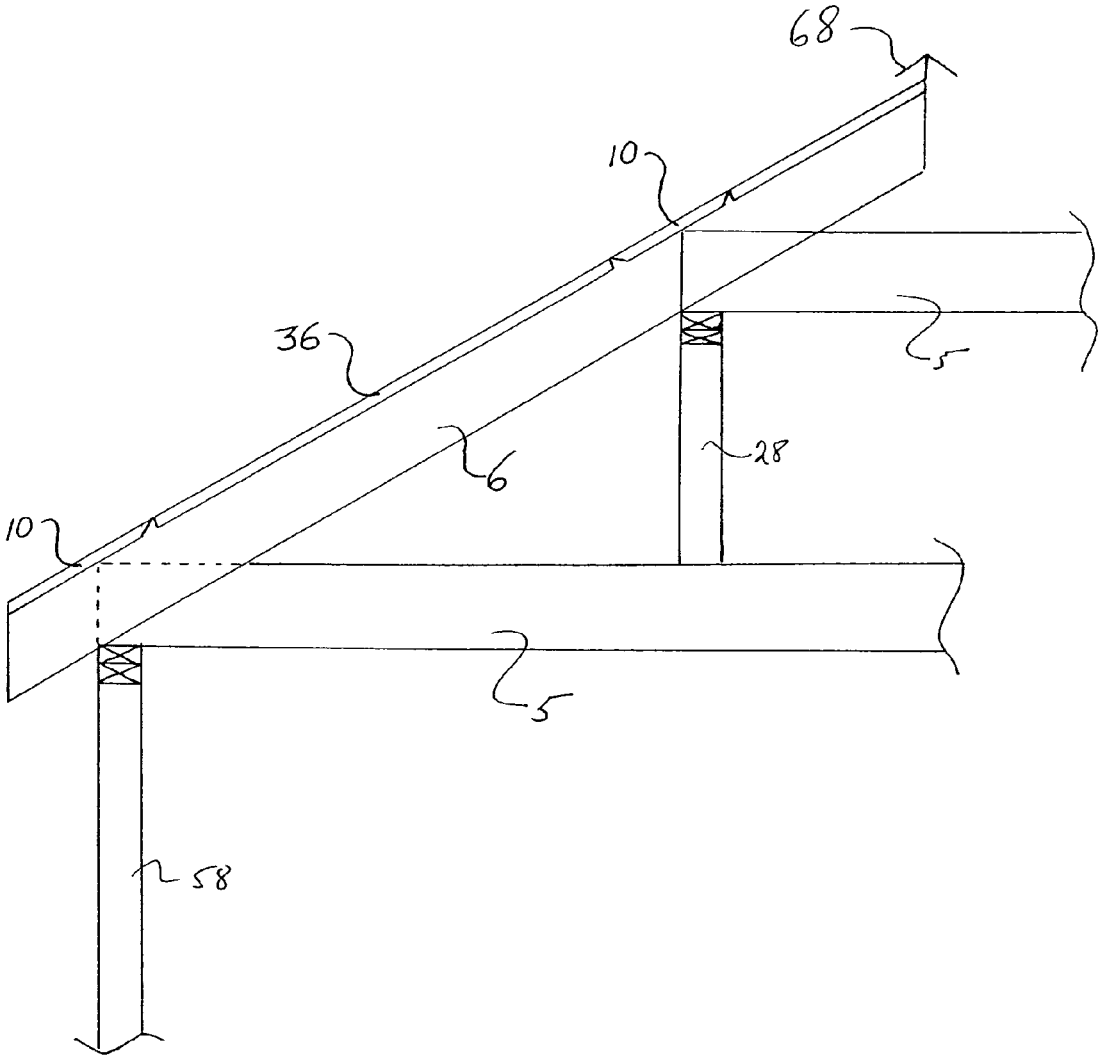
FIG. 3*b* is a rough schematic view of another roof line showing the venting system according to an aspect of the invention.

FIG. 3*a* shows a partial cross sectional view of the roof venting system 30 according to an aspect of the invention. The ceiling joist 5 meets with the roof rafter 6, and is faced with the fascia panel 7. According to an aspect of the invention, the lower portion 31 of roofing plywood sheathing 36 is removed to accommodate the venting system of the invention. Plywood 36 (i.e., roofing sheathing) is generally ½ inch, however other thicknesses are possible and will be discussed later. The amount of the lower portion 31 of plywood 36 removed can be in a range of 1-4 feet from the fascia panel 7. In other embodiments, the vent 10 can be randomly placed throughout the roof in order to bypass construction blockage. For Example, FIG. 3*b* shows a rough schematic view of vent 10 as installed in two places within the roof sheathing 36 to provide roof venting where blocked by the exterior wall 58 and the interior second floor wall 28.

Once removed, a new piece of plywood sheathing 34 is positioned in the lower portion 31 as a base for the new venting system. Plywood sheathing 34 has a thickness that is approximately ⅜ inch, such that the combined height of the vent 10 (with water protection membrane 32) and plywood 34 is substantially equal to the ½ inch plywood sheathing 36 above the lower portion 31. A water protection membrane 32 is positioned over plywood 34 and fascia panel 7 as shown, and vent 10 is then disposed on top of the water protection membrane 32. The openings 11 of vent 10 are exposed to the outside over the fascia panel 7. The angled end 12 is positioned to abut the upper sheathing 36, yet remain open to air flow by positioning the lower sheathing 34 such that a space 18 remains between the plywood sheathing 36 and lower plywood sheathing 34. Space 18 can be adapted for any application and is preferably in a range of 0.5-2 inches wide.

A second water penetration membrane 32 is disposed over the vent 10 and extends upward beyond the joining of vent plywood sheathing 36. Once the water penetration membrane 32 is positioned, the roofing material 38 can then be installed. As shown, the air openings 11 and 12, in addition to channel 14, provide free air flow from the outside up into the roof rafters. In this manner, air flow from the exterior of the structure can be provided into the roof rafters and thereby prevent the build of condensation and moisture that is otherwise trapped in an inadequately vented roof system.

As mentioned above, the combined height of the venting system 30 is such that it is flush (i.e., even with) the height of roof sheathing 36. Those of skill in the art will recognize that different thicknesses for plywood 36 can be used, and thus the thickness of lower sheathing 34 will change accordingly. For example, when plywood 36 is ½ inch thick, the combined height of channel vent 10, water protection membrane 32 and plywood 34 is the same ½ inch. For exemplary purposes, the channel vent 10 would be 3/32 inch, the water protection membrane would be 1/32 inch, and the plywood 34 would be ⅜ inch.

The same will be the case when plywood sheathing 36 is ¾ inch thick. In this instance, for example, the plywood 34 is ½ inch, while channel vent 10 is 7/32 inch and water protection membrane 32 is 1/32 inch.

In this respect, it is important that the combined vent 10 and underlying sheathing 34 comply with minimum sheathing requirements for roof installations, and in particular, the sheathing strength requirements for the same. In order to comply with these requirements, the wall between the vents 16 can be made thicker to increase the strength of the vent material 10 (e.g., for thinner overall vent material) in order to comply with any local or state sheathing strength requirements. In other terms, the combined strength of the vent 10 and underlying sheathing 34 must be equal to or greater than the sheathing strength of the full size sheathing 36 for that particular roof installation. In other contemplated embodiments, more than one layer of the vent material 10 can be stacked in order to provide a particular thickness, and/or to provide appropriate strength to comply with the minimum sheathing requirements.

By incorporating the venting system 30 into the actual roof, it is physically removed from the insulation and can no longer be subject to blockages caused by improper insulation installations. The integrated venting system of the present invention allows the venting of the roof by providing one continuous air flow from the exterior of the structure to the roof rafters and ultimately out a ridge or eave vent (See FIG. 4). This continuous air flow limits energy losses in heating and cooling the structure and also serves to completely eliminate chronic problems associated with condensation build up in unventilated roofs, and the extensive water damage caused by the same. In addition, those of skill in the art will recognize that the continuous air flow provided by the present invention also operates to evaporate ice or snow build up along the eve of the roof.

Figure 4:
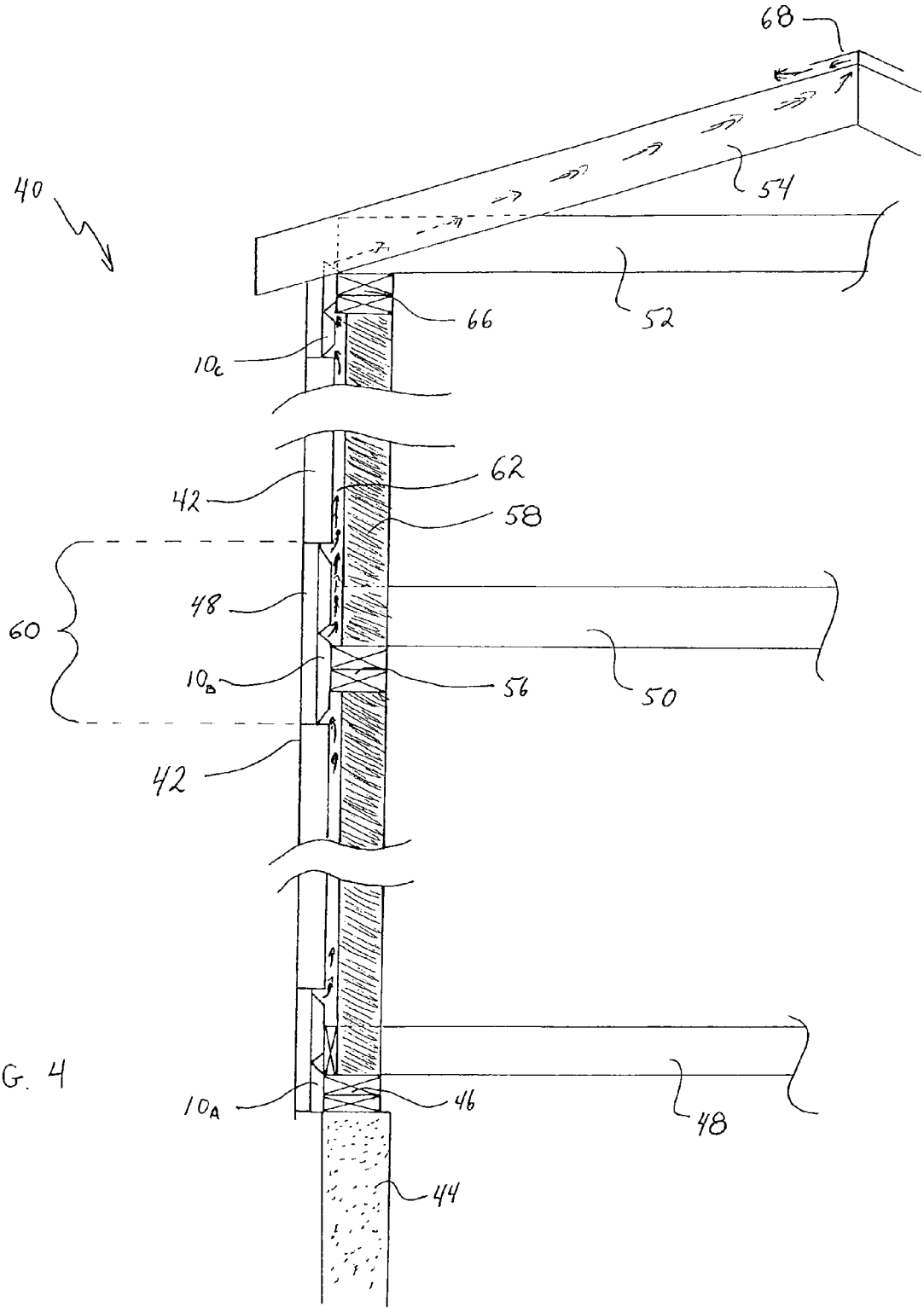
FIG. 4 is a partial cross sectional view of a wall showing the venting system according to another aspect of the invention.

FIG. 4 shows an exemplary implementation of the venting system 40 into a wall structure, according to an aspect of the invention. In this embodiment, not only are the walls provided with continuous air flow to vent the same through blockages (such as floors or ceilings), but also allow for much needed cross ventilation between the walls into the roof structure.

In structures having multiple floors, the floor joists 48, 50 (or the floors built thereon) often serve to block air passage through the wall from one floor to another. As shown, floor joist 48 sits on the sill plate 46 of foundation 44 and encloses the bottom of the wall (particularly when a floor is installed on the joists). By way of example, the second floor joists 50 sit on support post 56 and as such, the air flow within the wall and between the first and second floor is blocked. The wall insulation 58 is to be installed such that a small air gap 62 exists between the outer siding sheathing 42 and the insulation.

As shown, a portion 60 of the siding sheathing is removed that extends below and above the support 56 and floor joist 50. This portion 60 is then replaced with a channel vent 10*b* and a new piece of sheathing 48 having a thickness that allows the combined vent 10*b* and sheathing 48 to be flush with the original siding sheathing 42. In this manner, the air flow in the air gap 62 is re-opened between floors and any condensation that could ordinarily build up in this floor/ceiling junction is eliminated.

The same concept can be applied to the lower portion of the wall where vent 10*a* is installed to allow air flow over the sill plate 46 into the air gap 62 in the wall. In addition, an upper wall vent 10*c* can be implemented to carry the wall air gap 62 into the attic space and out the ridge vent 68 (or other eave vent not shown).

According to other contemplated embodiments, for new constructions, vent 10 can be incorporated into every wall of the structure, and may even become a first wall sheathing layer that can be used throughout the entire construction (i.e., ground level to roof level). In other embodiments, the vent 10 can be adhered to exterior insulation layers that are added to existing structures during re-siding or remodeling. In this embodiment, the vent will sit adjacent the siding sheathing and provide adequate air flow to the wall from the exterior. This may eliminate and will undoubtedly reduce any condensation or moisture build up in the wall.

Figure 5:
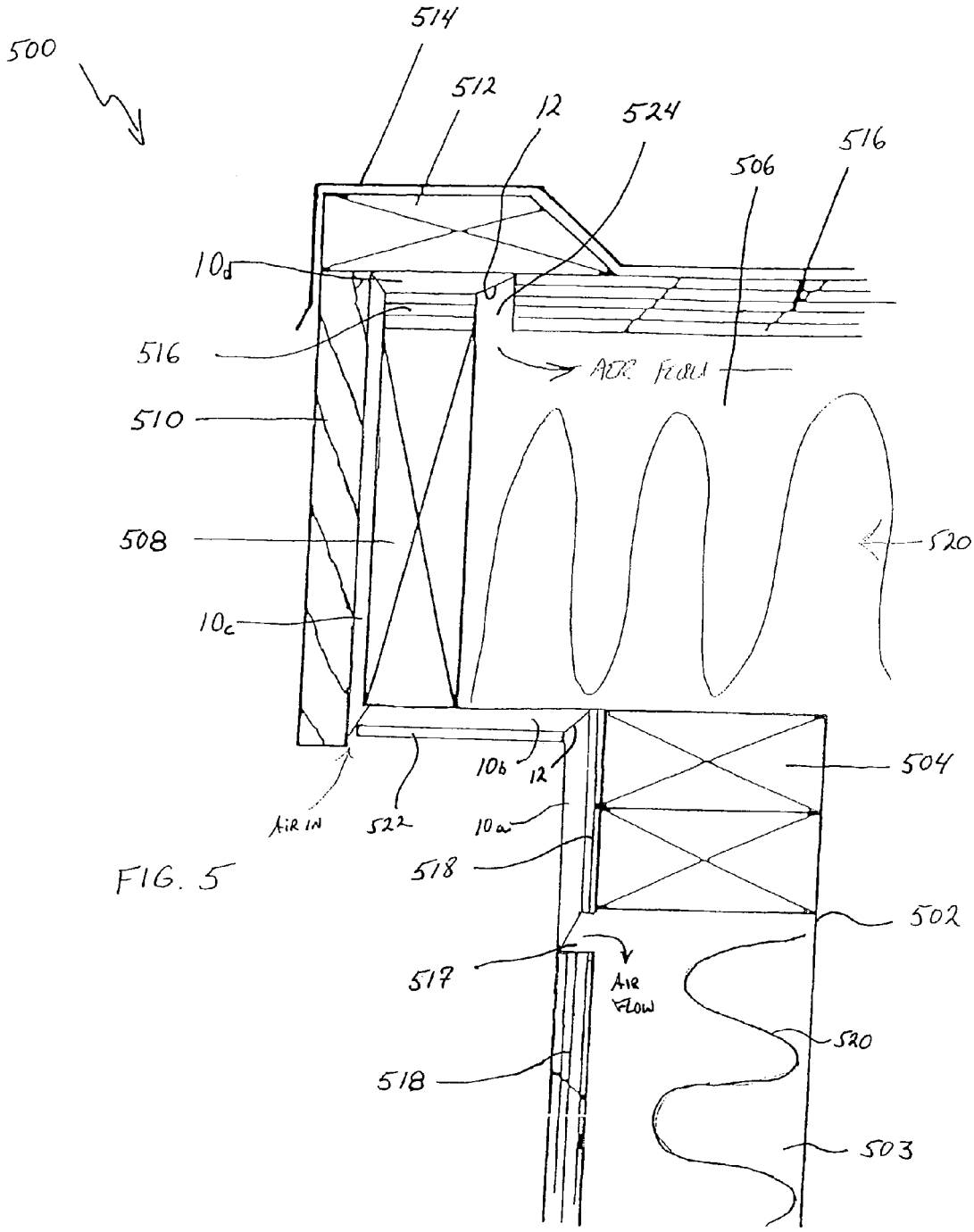
FIG. 5 is a partial cross sectional view of one type of flat roof showing the venting system according to an aspect of the invention.
Figure 6:
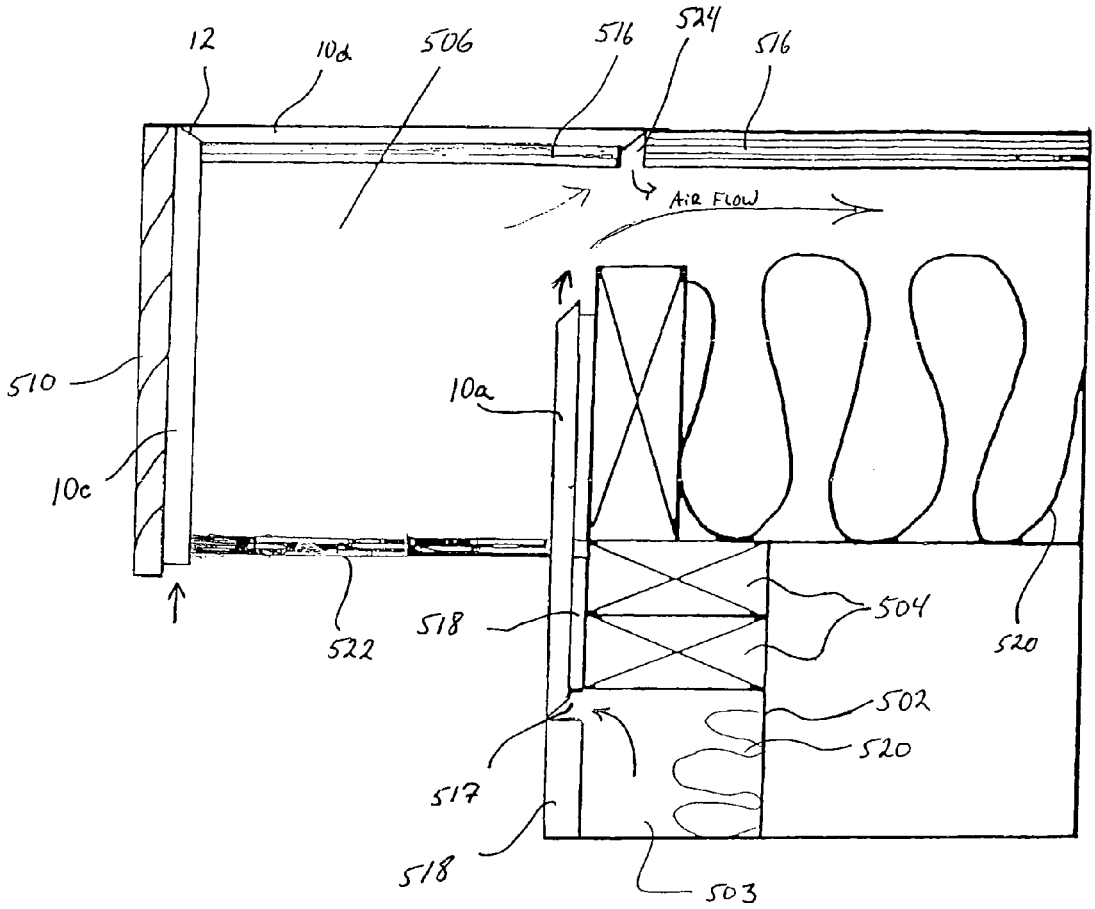
FIG. 6 is a partial cross sectional view of another type of flat roof showing the venting system according to an aspect of the invention.

FIGS. 5 and 6 show the venting system for flat roofs according to two different embodiments of the invention. Referring to FIG. 5, the Flat roof includes load bearing wall 502 having a stud 503 and double top plate 504. The exterior of the wall includes a sheathing 518. A rafter 506 is supported by the double top plate 504. The rafter 506 extends beyond double top plate 504 and serves to form soffet 522. A rough fascia 508 fronts the rafter(s) 506, and a finished fascia 510 over lays rough fascia 508. Several layers of sheathing (or other materials) 516 overlay rafter(s) 506 and rough fascia 508.

In accordance with the wall/roof venting system of the present invention, the vent 10 is incorporated to this otherwise standard flat roof construction. As shown, a portion of the wall sheathing 518 is removed, and a gap 517 is made in the sheathing so as to expose the same to the inside of the wall 502. Vent 10*a* replaces the removed sheathing and fills the gap 517 and abuts the lower sheathing 518. Vent 10*a* is preferably the same thickness as the removed sheathing so as to provide a flush transition between vent 10*a* and the remaining wall sheathing 518 immediately adjacent the same. Another vent 10*b* is disposed under the soffet sheathing 522 and connected to the wall vent by a 45 degree angled connection 12. A Fascia vent 10*c* is connected to the soffet vent 10*b* in the same angled manner. A top vent 10*d* is disposed between the rough fascia and the edge blocking 512 covered by the flashing 514. As shown, the top vent 10*d* is installed by removing some of the sheathing layers 516 in the room material.

In this manner, air flow between the wall and the flat roof is possible without affecting the construction of the flat roof. This continuous air flow will completely eliminate the potential for condensation build up in improperly vented/insulated walls or roofs. It will be apparent that for new constructions, the implementation and integration of vents 10 into the building is relatively easy and straight forward. For pre-existing constructions, the installed will be required to perform the following steps in order to retrofit an existing construction with the venting system of the present invention:

1) remove the fascia board 508;
2) cut flat roof to make gap 524 that is beyond any potential air flow blockages;
3) measure thickness of existing sheathing 516 and subtract thickness of vent from sheathing 516 and remove the same from above the rough fascia board 508.
4) install top vent 10*d* and with angled end 12 disposed in gap 524 and the opposing angled end connected to the fascia vent;
5) remove soffet 522;
6) install fascia vent 10*c* and adhere same to rough fascia board 508;
7) remove siding (not shown) and cut out sheathing 518 in wall 502, subtract thickness of wall vent 10 from sheathing thickness;
8) install soffet vent 10*b* and adhere same to underside of rafter(s) 506;
9) install wall vent 10*a* such that gap 517 is closed and vent 10*a* is flush with the adjacent wall sheathing 518
10) re-install finished fascia 510 over vent 10*c*, and edge blocking 512 and flashing 514 over the vent 10*d*, gap 524 and finished fascia 510; and
11) re-install siding and soffet 522 over flush mounted venting system.

FIG. 6 shows another type of flat roof construction, where two separate vents are used to vent the wall and the roof. As shown, a single vent 10*a* is installed along the exterior of the wall 502 and recessed into the sheathing 518 as described above with reference to the embodiment of FIG. 5. Vent 10*c* is installed behind finished fascia 510 and connected with the top vent 10 that is flush mounted with the roof sheathing 516 so as to be open in the gap 524 formed in the roof sheathing 516. In this manner, air flow from vent 10*a* vents wall 502 into the roof rafters 506, while vents 10*c* and 10*d* combine to vent the overhang portion the roof (i.e., soffet).

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A venting system for roofs, the roofs having a sheathing of a predetermined thickness according to minimum strength requirements, the venting system comprising:

an opening in a roof sheathing extending from the base of the roof upward toward a peak of the roof;

a lower support member positioned in said opening such that a gap between the lower support member and the roof sheathing exists, said lower support member having a thickness smaller than said predetermined thickness of the roof sheathing; and a channel vent disposed in said opening and on said lower support member, said channel vent having a plurality of parallel vents with open ends and a thickness smaller than said predetermined thickness of the roof sheathing;

wherein at least one of said open ends is disposed in said gap.

2. The roof venting system according to claim 1, further comprising a first water protection membrane disposed over said lower support member such that it is between said channel vent and said lower support member.

3. The roof venting system according to claim 2, further comprising a second water protection membrane disposed over the roof venting system and extending up onto the roof sheathing above the roof venting system in the direction of a roof peak.

4. The roof venting system according to claim 1, wherein said lower support member and said channel vent have a combined thickness equal to a thickness of the upper roof sheathing.

5. The roof venting system according to claim 4, wherein the combined thickness of said channel vent and said lower support member in the opening have a minimum strength equal to or greater than the minimum strength requirement of the roof sheathing.

6. A venting system for roofs, the roofs having a sheathing of a predetermined thickness according to minimum strength requirements, the venting system comprising:

at least one opening in a roof sheathing extending from the base of the roof upward toward a peak of the roof;

at least one lower support member positioned in each of said at least one openings such that a gap between the at least one lower support member and the roof sheathing exists, said at least one lower support member having a thickness smaller than said predetermined thickness of the roof sheathing; and at least one channel vent disposed in said at least one opening and on said at least one lower support member, said at least one channel vent having a plurality of parallel vents with open ends and a thickness smaller than said predetermined thickness of the roof sheathing;

wherein at least one of said open ends is disposed in said gap.

7. The roof venting system according to claim 6, further comprising a first water protection membrane disposed over said at least one lower support member such that it is between said at least one channel vent and said lower support member.

8. The roof venting system according to claim 7, further comprising a second water protection membrane disposed over the roof venting system and extending up onto the roof sheathing above the roof venting system in the direction of a roof peak.

9. The roof venting system according to claim 6, wherein said at least one lower support member and said vent at least one channel have a combined thickness equal to a thickness of the roof sheathing.

10. The roof venting system according to claim 9, wherein the combined thickness of said at least one channel vent and said lower support member in the opening have a minimum strength equal to or greater than the minimum strength requirement of the roof sheathing.

11. A method for venting a roof comprising:

removing a lower portion of a roof sheathing of a predetermined thickness;

positioning a lower support member in the removed lower portion so as to define a gap between the lower support member and the remaining roof sheathing said lower support member having a thickness smaller than said predetermined thickness of the roof sheathing;

providing a channel vent disposed on said lower support member and extending from a roof base to the remaining roof sheathing, said channel vent having one open end exposed to exterior air at the roof base and another open end disposed in said defined gap said channel vent having a thickness smaller than said predetermined thickness of the roof sheathing; and providing a water protection membrane adapted to cover said channel vent and extend upward from the roof base beyond said defined gap.

12. The method according to claim 11, wherein said removing is performed by cutting the lower portion of the roof sheathing.

13. The method according to claim 11, wherein said channel vent and said lower support member have a combined thickness equal to a thickness of the remaining roof sheathing.

14. The method according to claim 11, wherein said providing a water protection membrane comprises installing an ice dam prevention material over the channel vent and extending upward from the roof base beyond the defined gap.

15. A venting system for roofs, the roofs having a sheathing of a predetermined thickness and an upper roofing material, the venting system comprising:

an opening in a roof sheathing extending from the base of the roof upward toward a peak of the roof;

a lower support member positioned in said opening such that a gap between the lower support member and the roof sheathing exists, said lower support member having a thickness smaller than said predetermined thickness of the roof sheathing;

a channel vent disposed in said opening and on said lower support member, said channel vent having a plurality of parallel vents with open ends and a thickness smaller than said predetermined thickness of the roof sheathing, wherein at least one of said open ends is disposed in said gap; and a water protection membrane disposed between the channel vent and the lower support member;

a water protection membrane disposed between the channel vent and an upper roofing material wherein a combined thickness of said lower support member and said channel vent is equal to said predetermined thickness of the sheathing.

* * * * *